US007692110B2

(12) United States Patent
Hong

(10) Patent No.: US 7,692,110 B2
(45) Date of Patent: Apr. 6, 2010

(54) TILT SWITCH

(75) Inventor: Wen-Jen Hong, Taipei (TW)

(73) Assignee: Taiwan Misaki Electronics Co., Ltd., Taoyuan (TW)

( * ) Notice: Subject to any disclaimer, the term of this patent is extended or adjusted under 35 U.S.C. 154(b) by 360 days.

(21) Appl. No.: 11/812,286

(22) Filed: Jun. 18, 2007

(65) Prior Publication Data

US 2008/0017488 A1 Jan. 24, 2008

(30) Foreign Application Priority Data

Jul. 24, 2006 (TW) ..... 95126903 A

(51) Int. Cl.
*H01H 35/14* (2006.01)

(52) U.S. Cl. ..... 200/61.52; 200/61.45 R

(58) Field of Classification Search ..... 200/61.52, 200/61.45 R, 61.46–61.48, 61.5, 277, 52 A
See application file for complete search history.

(56) References Cited

U.S. PATENT DOCUMENTS 6,198,059 B1 * 3/2001 Jou ..... 200/61.52

* cited by examiner

*Primary Examiner*—Renee S Luebke
*Assistant Examiner*—Marina Fishman
(74) *Attorney, Agent, or Firm*—Bacon & Thomas, PLLC

(57) ABSTRACT

A tilt switch comprises an insulating housing, a cover covering the opening of the housing, three terminals fixed at the bottom of the housing and an electrically conductive ball movably received in the housing to on/off the switch by contacting/leaving said terminals. Three terminals are located at each vertex position of a triangle such that one terminal having a polarity opposite to the other two terminals and a protruding length longer than those of the other two terminals, allowing elevation difference to exist between them.

5 Claims, 6 Drawing Sheets

TILT SWITCH

BACKGROUND OF THE INVENTION a) Field of the Invention

The present invention relates to a tilt switch, and more particularly to a tilt switch which is installed on all kinds of machines including an electronic machine, a control device, or a measurement machine, for detecting their tilt or vibration.

b) Description of the Prior Art

A ball member vibration switch, as disclosed by the Taiwanese Utility Model Patent No. 468865, includes an insulating housing, an interior of which is provided with an electrically conductive metal ball member and a plurality of electrically conductive terminals. By tilt of the insulating housing, the ball member will move between positions where the ball member is and is not in contact with the terminals, to perform an ON/OFF operation of the switch, so as to detect the tilt or vibration of a machine which is installed with this switch.

Referring to FIGS. 9 to 11, this switch is provided with an insulating housing 10, an opening part of which has a larger diameter, and a bottom part of which is formed with an accommodating space 101 in a shape of a funnel. An electrically conductive ball member 102 is movable and accommodated in an interior of the accommodating space 101 of the insulating housing 10, two pairs of electric contact members t1, t2 which have opposite polarities, are protruded from an inner side at the bottom of the insulating housing 10, and a cap 104 covers the opening part of the insulating housing 10.

Referring to FIG. 9, this kind of switch is usually installed on a target machine horizontally. In this situation, the ball member 102 is located in the large-diameter part of the accommodating space 101 without contacting the contact members t1, t2, and the switch is at an OFF state. If the insulating housing 10 is lifted upward at an end of the cap 104 from this horizontal state, allowing the switch to tilt as shown in FIG. 10, then the ball member 102 will roll toward the left side funnel part, due to its weight. When a tilt angle of the switch exceeds 45 degrees, the ball member 102 will fall into the funnel part to contact the four contact members t1, t2, thereby constituting an ON state. Accordingly, by the movement of the ball member, and the extent of tilting of the switch, the ON/OFF operation can be carried out.

In addition, the Japanese Utility Model Patent No. 9-7475 discloses an inclination detection switch which includes an insulating substrate, a plurality of terminals inserted into terminal holes on the insulating substrate, a case-shape housing which covers this insulating substrate, and an electrically conductive ball member which is movable and contained in an interior of the housing, wherein contact parts at top ends of the terminals are formed with knife-like edges, and the ball member crosses over the knife-like edges, thereby reducing contact area of the ball member with the knife-like edges to increase contact pressure per unit area.

Furthermore, the Japanese Utility Model Patent No. 11-232973 discloses a direction detection type inclination switch, which consists of a base with a top face being in a funnel shape, at least one or more light-emitting elements arranged in a center of the funnel-like part for emitting light toward an upper part of the base, a plurality of light-receiving bodies arranged around the light-emitting element, a light shielding ball which is freely movable and mounted on the base, and a cap which accommodates this light shielding ball and covers an inner surface of the base for forming a reflection face. The inclination switch constituted in such a manner can detect the inclination direction by shielding the light receiving body in front of the moving direction, due to the free movement of the light shielding ball in the inclined direction.

However, for the switch which is disclosed by the Taiwanese Utility Model Patent No. 468865, the bottom part of its insulating housing needs to form the cone-shape funnel part at about 45 degrees, and the ON and OFF operations of the switch are dependent upon whether the tilt angle of the switch exceeds 45 degrees; that is, the tilt angle of 45 degrees is a critical angle for the operation of the switch. At this critical angle of 45 degrees, vertical component of force of the electrically conductive ball member is identical to its horizontal component of force; therefore, the ball member is under an unstable condition, and the switch is easy to manifest an intermittent and non-steady ON/OFF state. In addition, as the ball member is supported by the front ends of two pairs of contact members that are configured on a same plane, it is easy to form unstable condition that maintaining the stable operation for the switch will be difficult, if only slight tilt or vibration occurs. Moreover, as the operation angle of the switch is fixed at 45 degrees, this angle cannot be changed or adjusted.

For the detection switch disclosed by the Japanese Utility Model Patent No. 9-7475, as the contact end of the terminal is formed with the knife-like shape, the structure of terminal will become complicated. At a same time, the operation angle of the switch cannot be changed freely, either.

On the other hand, the switch disclosed by the Japanese Utility Model Patent No. 11-232973 includes the light-emitting element and a plurality of light receiving bodies, whereas the inner surface of the cap is formed with the reflection surface. Therefore, when the switch tilts, the ball member will roll to shield the light receiving body in the rolling direction, such that the light receiving body is not irradiated by the light, and is thus not operable, thereby detecting the inclination direction of the switch. This kind of switch has a complicated structure and high manufacturing cost. In a mean time, its construction is not the same as the construction and principle for turning on and off the tilt switch by directly contacting the ball member with the terminals, as disclosed by the aforementioned Taiwanese Utility Model Patent No. 468865 and the Japanese Utility Model Patent No. 9-7475.

SUMMARY OF THE INVENTION

Accordingly, the present invention is developed to solve the aforementioned problems, and the primary object of the present invention is to provide a tilt switch which is supported by three points from three terminals with elevation difference for easily gaining mechanics balance, if an electrically conductive ball member of which is at an ON state, so as to decrease an intermittent electric conduction phenomenon upon performing an ON/OFF operation at a critical angle. In a mean time, the switch is constructed that its operation angle (tilt angle) is easily changed or adjusted, that it is provided with a good operability and a simple structure, as well as that it is easily assembled.

Accordingly, the tilt switch of the present invention includes an insulating housing, an end of which is provided with an opening, the other end of which is a closed bottom, and which is in a case shape; a cap, which covers the opening of the aforementioned insulating housing; a plurality of terminals which are parallel transfixed into terminals holes at the bottom of the aforementioned housing, with one end of each of which being protruded into an interior of the housing, and the other end of each of which being protruded out of the bottom; and an electrically conductive ball member, which is freely movable and accommodated in an interior of the aforementioned housing, as well as serves as a movable contact. By tilt of the insulating housing, the electrically conductive ball member rolls to contact and remove from the protrusion ends in the housing to proceed with the switching operation. There are three terminals which are located at the bottom of the aforementioned housing and are aligned in a triangular shape, wherein one terminal has a polarity opposite to those of the other two terminals, and one terminal protrudes inward to the housing by a section longer than those of the other two terminals, allowing elevation difference to exist between that terminal and the other two terminals. Accordingly, when the aforementioned housing tilts to enable the electrically conductive ball member to contact the aforementioned three terminals, the electrically conductive ball member will be at a stable contact state, due to that the three terminals maintain the balance state.

In the switch of the present invention, the aforementioned triangle formed by the installation locations of those three terminals is usually an equilateral triangle or an isosceles triangle, with diameter of its circumscribed circle being smaller than diameter of the aforementioned electrically conductive ball member.

Furthermore, at least one aforementioned terminal of the three terminals in the present invention is configured as that its protrusion length in the insulating housing can be freely adjusted relative to the aforementioned insulating housing. Also in the present invention, a central part of an inner wall of the insulating housing, facing one terminal, is provided with a guide member which faces to and is parallel to the terminal, so as to change thickness of the guide member for adjusting the ON/OFF tilt angle of the switch. This guide member can be formed integrally with the insulating housing or can be freely assembled with or disassembled from the housing.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
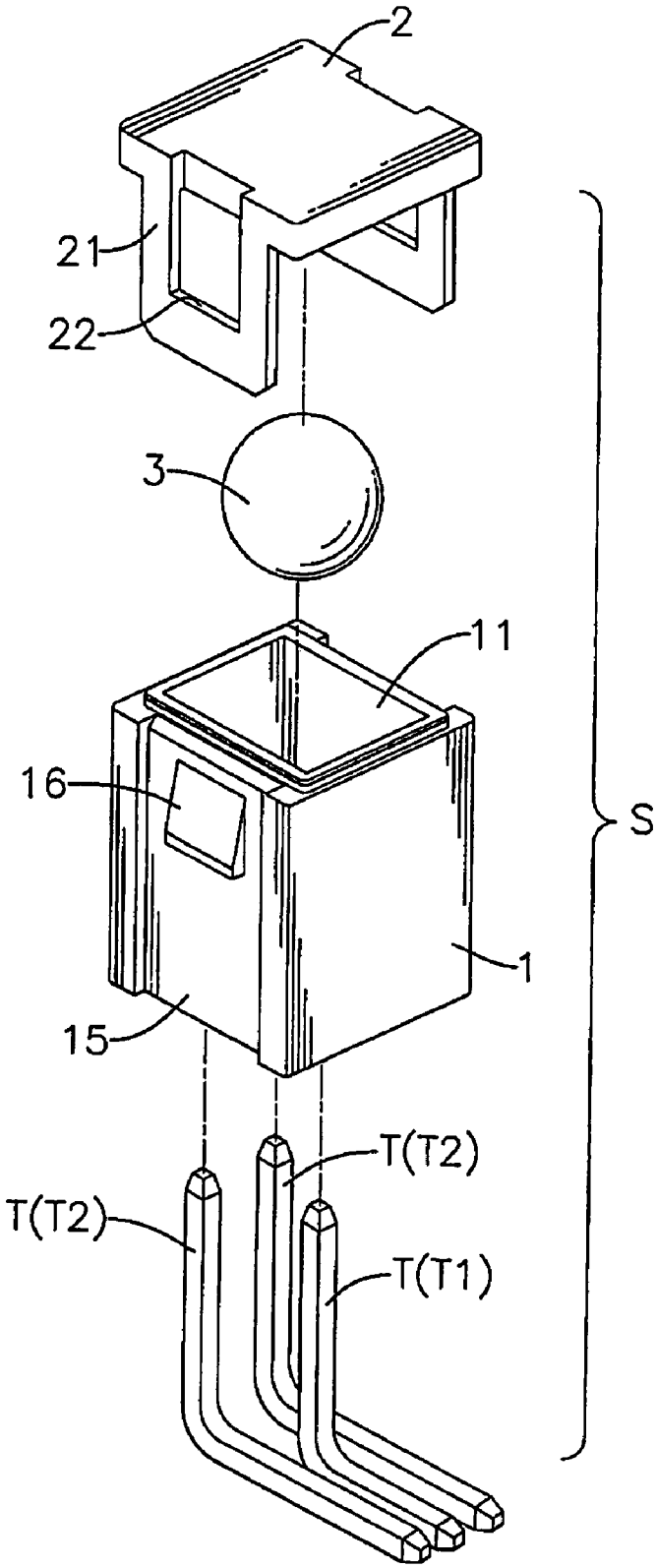
FIG. 1 shows an exploded view of a first embodiment of a tilt switch of the present invention.
Figure 2:
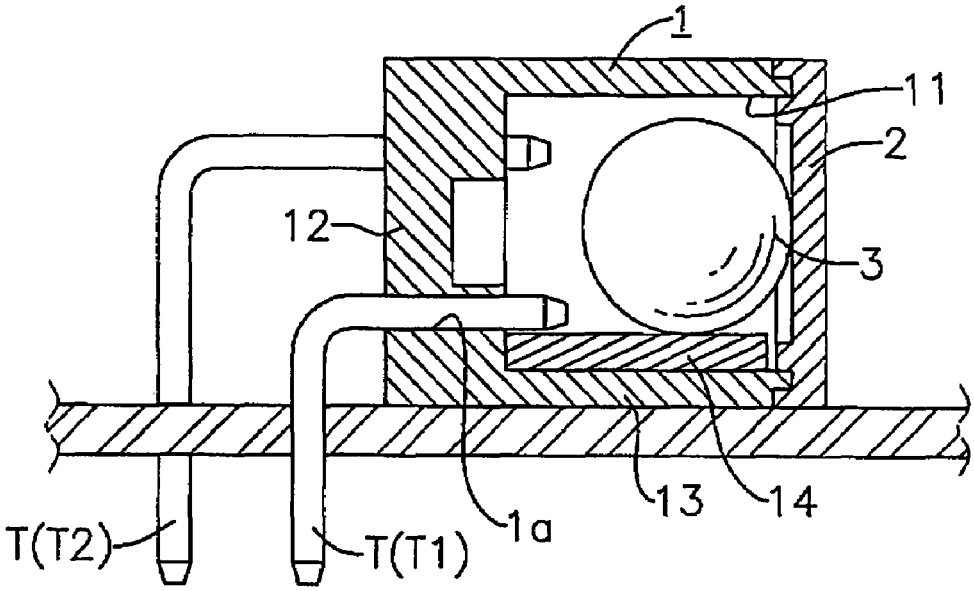
FIG. 2 shows a partial cutaway view of an assembly state of FIG. 1.
Figure 3:
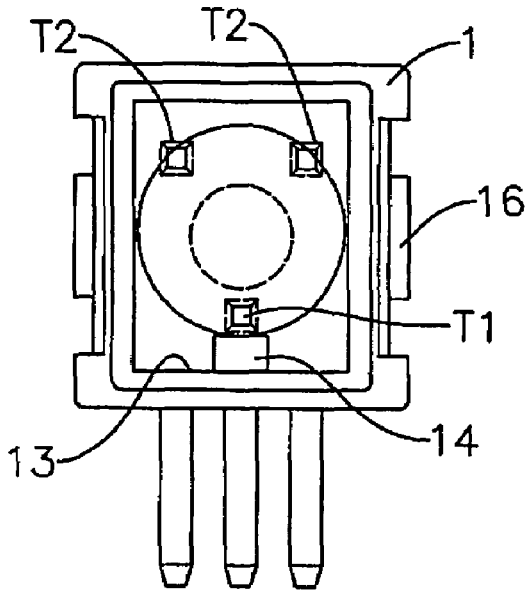
FIG. 3 shows an end view of a switch after dismantling a cap, according to FIG. 1.

A first embodiment of a tilt switch of the present invention is described with FIGS. 1 to 3. Referring to FIG. 1, it shows an exploded view of the first embodiment of the tilt switch of the present invention, wherein a tilt switch S includes a case-shape insulating housing 1, an end of which is provided with an opening 11; a cap 2 which covers the opening 11 of the housing 1; three terminals T which are inserted at a bottom 12 of the housing 1; and an electrically conductive ball member 3 which is freely movable and accommodated in an interior of the housing 1.

Referring to FIG. 2, it shows a partial cutaway view of a state that the switch S is transversally installed on an electronic machine M, after being assembled. FIG. 3 shows an end view of the switch S after the cap 2 is dismantled. It can be seen from FIG. 2 and FIG. 3 that the three terminals T are mutually parallel with one another, at each vertex position of a triangle which is formed by connecting the vertexes with straight lines, upon installing the three terminals T.

In this embodiment, one terminal T1 at a lower side position of the housing 1 is inserted into a terminal hole 1*a* at the bottom 12 of the housing 1, corresponding to a vertex position of an inverted triangle; whereas, two other terminals T2 at upper side positions are inserted into the terminal holes 1*a* at the bottom 12, corresponding to two end positions of a bottom edge of the aforementioned inverted triangle, with the terminal T1 having an opposite polarity to the terminals T2. For example, if the polarity of the terminal T1 is positive, then the other two terminals T2 are negative. On the contrary, if the terminal T1 is negative, then the terminals T2 will be positive. However, this setting is not restricted; for example, if the terminal T1 is positive or negative, then the two terminals can have two different polarities, with one terminal being positive, and the other terminal being negative.

Inner diameter of the housing 1 is larger than diameter of the electrically conductive ball member 3 which is accommodated in the interior of the housing 1 to serve as a movable contact. Therefore, the ball member 3 can roll freely inside the housing 1. In addition, diameter of a circumscribed circle of the triangle formed by three fixing terminals T1, T2, T2, is smaller than the diameter of the electrically conductive ball member 3. Therefore, when the switch is ON, the terminals can support a lower hemisphere underneath the diameter of the ball member 3 by three points. Furthermore, an inner wall of the housing 1 that is close to a central part of a wall 13 of the terminal T1, is integrally formed with a protruded guide member 14 which extends from the opening 11 along the terminal T1 side (that is, along axis direction) toward the bottom 12 or its proximity. By this guide member 14, the ball member 3 can be guided to quickly move to a front end of the terminal T1. The guide member 14 is formed as a rectangular plate or rib, with its upper surface being a plane or arc cross section.

There is no special limitation to the cap 2 for closing the opening 11 of the housing 1, as long as that it can seal the opening 11. In this embodiment, the cap 2 is formed as a U-shape structure capable of covering the opening 11 of the housing 1, and a part of two outer walls. The cap 2 is latched into two grooves 15 which extend axially on the two side walls of the housing 1 by two side pieces 21, and locking holes 22 of the two side pieces 21 are locked with wedge-shape locking projections 16 inside the grooves 15, to assemble with the housing 1 into one body. Although not shown on the drawings, the cap 2 and the housing 1 can be mutually latched by projected strips or grooves, or can be assembled by adhesive agents.

Upon assembling the aforementioned tilt switch, first of all, three terminals T are inserted into the terminal holes 1*a* at the bottom 12 of the housing 1 to be fixed, or inserted into an injection mold and constituted with the housing 1 into one body when the housing 1 is molded. Next, the ball member 3 is emplaced into the housing 1, followed by covering the opening 11 of the housing 1 with the cap 2, thereby accomplishing the assembly of the switch S.

Figure 4:
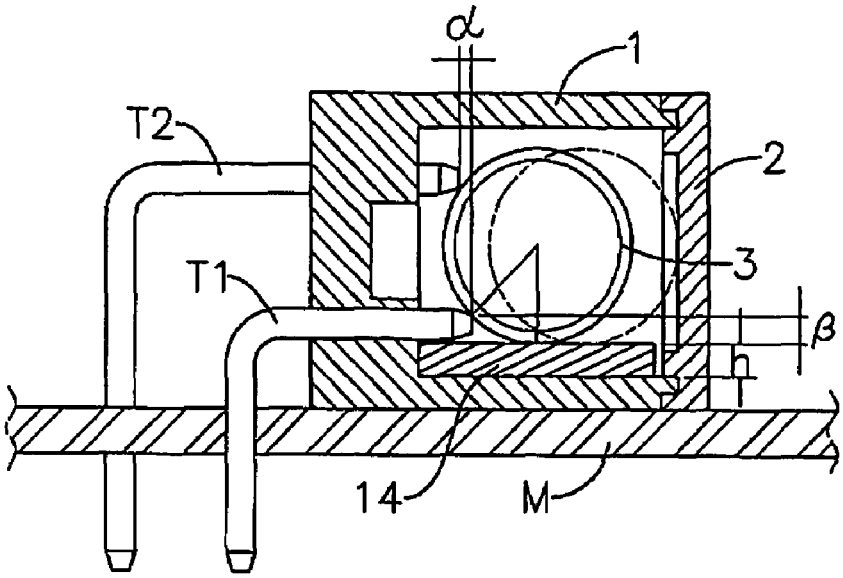
FIG. 4 shows a cutaway view of a usage state when a switch of a first embodiment is at an OFF position.
Figure 5:
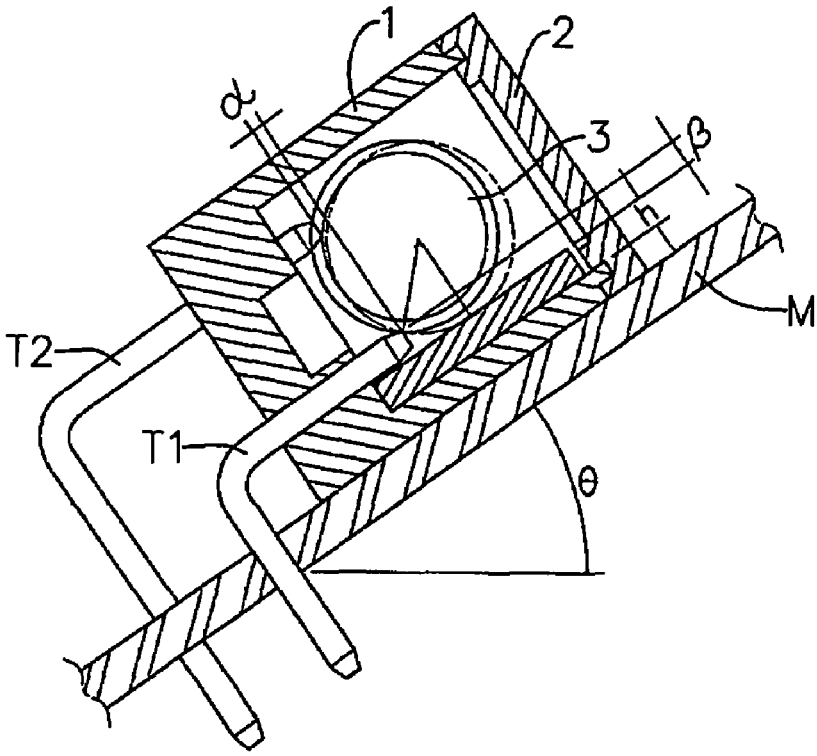
FIG. 5 shows a cutaway view of a usage state when a switch of FIG. 4 is at an ON position.

The switch S is usually installed on the electronic machine M in a horizontal state for use, as shown in FIG. 4. Under this state, the switch is at an OFF state, and the ball member 3 is only in touch with the front end of the terminal T1 (represented by the solid line) or is not in touch with the terminal T1 (represented by the dotted line) at all, in the housing 1. However, when the switch S allows an end of the housing 1 to be lifted up as shown in FIG. 5, due to that the electronic machine M tilts in counterclockwise direction; the ball member 3 will roll down along the tilted wall. When the switch tilts to exceed the specified operation angle, i.e., the tilt angle θ, the ball member 3 will cross over the front end of the lower terminal T1 by its weight, to contact the front end of the upper terminal T2. As the diameter of the ball member 3 is larger than the diameter of the circumscribed circle of the triangle constituted by the terminals T1, T2, and the movement of the ball member 3 is restricted by the inner wall of the housing 1, the ball member 3 will contact the terminals T1, T2, to form an ON state.

On the other hand, when the switch restores reversely from the tilt position as shown in FIG. 5, to original horizontal state, the ball member 3 will first escape from the terminals T2 due to its weight, and then cross over the terminal T1 to fall on a top of the guide member 14, thereby restoring with the switch to the horizontal state as shown in FIG. 4. Therefore, the switch will be at an OFF state.

The critical angle (the tilt angle θ) of the aforementioned ON/OFF operation is determined by elevation difference α between the terminal T1 and the terminal T2 in a specified range. In other words, in the specified range, the larger the elevation difference α is, the smaller the tilt angle θ will be; and the smaller the elevation difference α is, the larger the tilt angle θ will be. Therefore, by adjusting the magnitude of the elevation difference α, the tilt angle θ can be configured at the required degrees.

To achieve the aforementioned objects, the length of the front end of the terminal T1 that protrudes out of the bottom 12 of the housing 1 can be freely adjusted. At this time, the terminal T2 can be configured as a fixed type that is fixed at the bottom 12. On the contrary, if the terminal T2 is configured as an adjustable type, then the terminal T1 can be also configured as the fixed type. Under any aforementioned situation, the protrusion length of the terminal T2 cannot be longer than that of the terminal T1.

To adjustably install the terminal T1 or T2, an end of the terminal is threaded to screw with an adjustable nut installed on the housing 1 (not shown on the drawings), which belongs to a prior art. All kinds of terminals of different lengths can be prepared, on the other hand, and adequate terminals can be chosen according to requirement of a user, to be installed on the housing 1, or to be embedded in a molding tool to be formed integrally with the housing 1.

Figure 6:
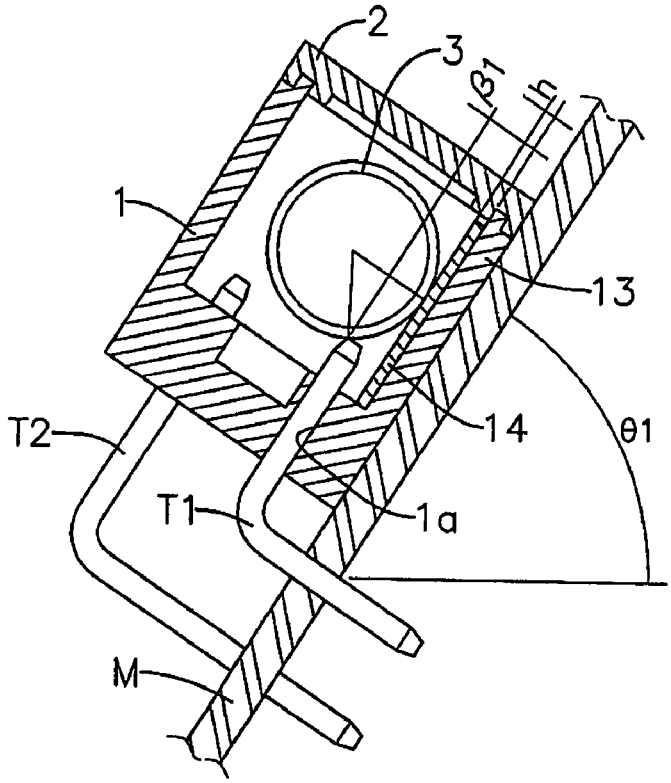
FIG. 6 shows a cutaway view of a usage state of a second embodiment of a tilt switch of the present invention.
Figure 7:
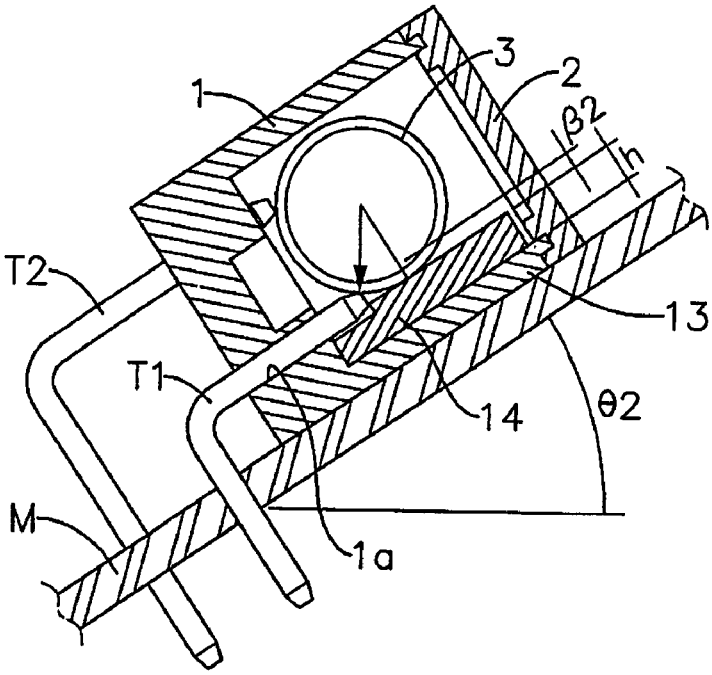
FIG. 7 shows a cutaway view of another usage state of a switch of FIG. 6.

Referring to FIG. 6 and FIG. 7, it shows schematic views of a second embodiment of the tilt switch of the present invention. In this embodiment, all of the components that are the same as those of the first embodiment will use the same numerals, and their descriptions are omitted.

The second embodiment is provided with the same fundamental structures as those of the first embodiment, including still the housing 1, the cap 1, the ball member 3, and three terminals T. The difference is that in the first embodiment, the tilt angle θ for the ON/OFF operation of the switch is determined by the elevation difference α between the terminals, whereas in the second embodiment, in addition to depending upon the elevation difference α, the tilt angle θ can be also determined by a radial gap β between a top surface of the conductive member 14 on the inner wall 13 and the front end of the terminal T1 that contacts with the ball member 3.

The larger the gap β is, the larger the tilt angle θ that the ball member 3 crosses over the front end of the terminal T1 will be. On the contrary, the smaller the gap β is, the easier the ball member 3 will cross over the front end of the terminal T1, and thus the smaller the tilt angle θ will be. Therefore, the magnitude of the gap β can also determine the magnitude of the tilt angle θ.

FIG. 6 shows a schematic view of a usage state of a switch having a larger gap β1, wherein the tilt angle θ1 for the ON/OFF operation is larger. On the other hand, FIG. 5 shows a schematic view of a usage state of a switch having a gap β smaller than the aforementioned gap β1, wherein the tilt angle θ is also smaller.

FIG. 7 shows a schematic view of a usage state of a switch having a gap β2 further smaller than the gap β, wherein the tilt angle θ2 for the ON/OFF operation is even smaller than θ. From FIG. 7 it can be shown that to reduce the gap β2, an upper part at one end of an inner side of the guide member 14 is cut off to form a stage part which is touched by a lower part of the terminal T1.

To achieve the aforementioned objects, for the terminal T1 with a fixed installation position, the magnitude of the gap β can be adjusted by increasing or decreasing radial height (thickness) h of the guide member 14, thereby adjusting the magnitude of the tilt angle θ. The height h of the guide member 14 can be determined according to the tilt angle required by the user. This guide member 14 can be formed integrally with the housing 1, so as to avoid the assembly of the guide member 14. If the height h of the guide member 14 needs to be changed, replacing a core of a mold is sufficient. In other embodiments, the guide member 14 is molded separately and then assembled at the inner wall 13 of the housing 1.

Figure 8:
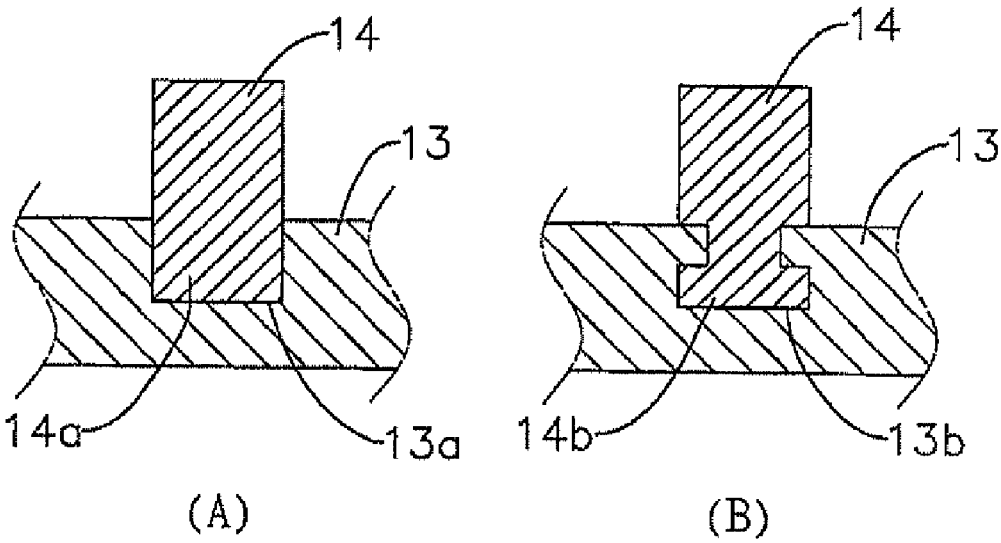
FIG. 8 shows an exploded view of two embodiments that a guide member is assembled with an insulating housing.
Figure 9:
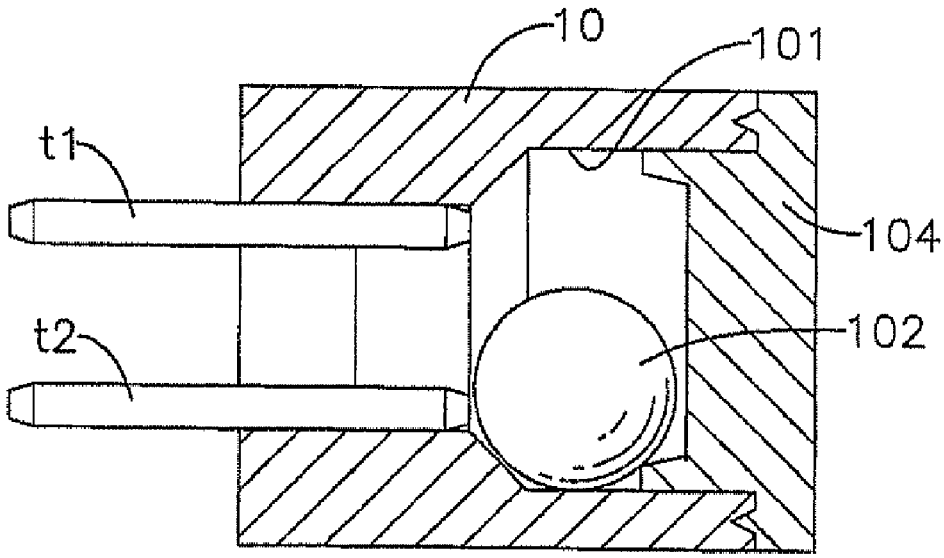
FIG. 9 (Prior Art)
FIG. 9 shows a cutaway view of an embodiment of a conventional tilt switch.
Figure 10:
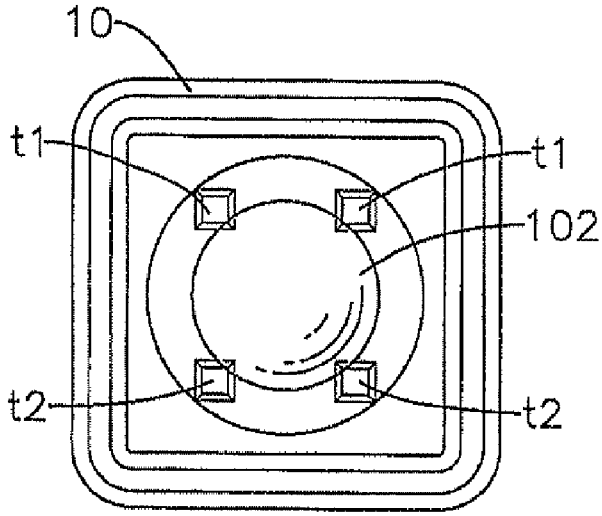
FIG. 10 (Prior Art)
FIG. 10 shows an end view of a switch after dismantling a cap, according to FIG. 9.
Figure 11:
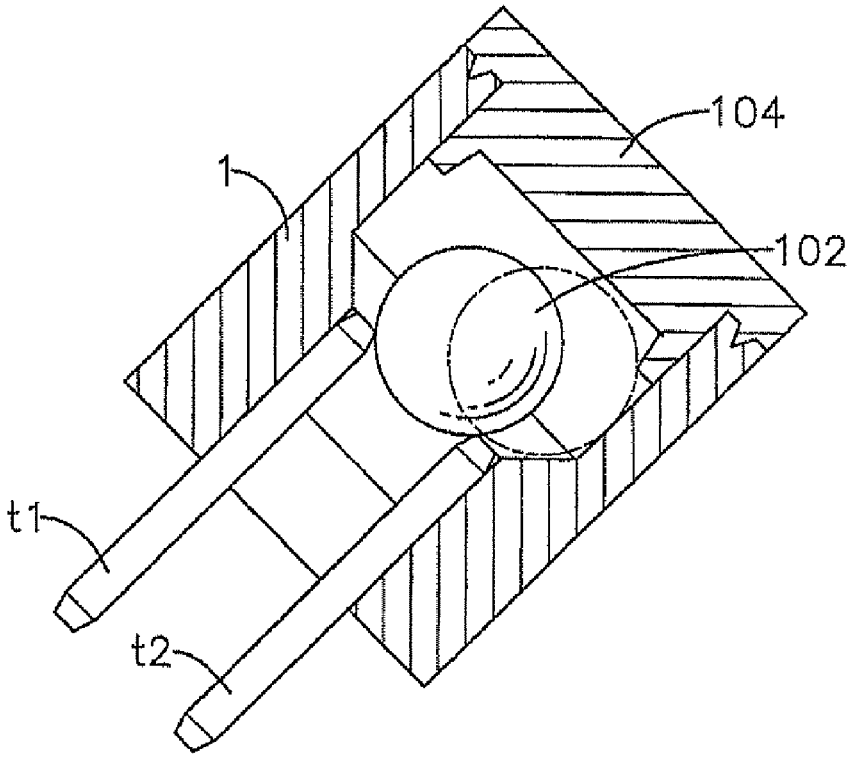
FIG. 11 (Prior Art)
FIG. 11 shows a cutaway view of a usage state of a switch of FIG. 9.

To assemble the guide member 14 with the housing 1, a base portion 14*a* of the guide member 14 is pressed into a corresponding axial groove 13*a* on the inner wall 13 for fixing, as shown in FIG. 8(A); or an inverted T-shape base portion 14*b* of the guide member 14 can be engaged into the same shape of groove 13*b* for assembling, as shown in FIG. 8(B). However, the assembly means is not limited to the aforementioned embodiment, a conventional assembly or installation device can be used too. If the guide member 14 is constructed as a structure that can be freely installed into or removed from a groove, then there is no need to change the molding tool but to replace with the guide member 14 of different thickness for achieving an advantage of changing the tilt angle θ easily.

Accordingly, at the ON position of the switch, the electrically conductive ball member is supported by three terminals with the elevation difference, to configure as a triangle, thereby easily achieving a stable mechanics balance by three points. At the same time, the ball member is blocked by the terminal which protrudes longer, to have a tendency to move toward the other two terminals in front of the tilt direction;

therefore, the intermittent electric conduction phenomenon can be reduced upon performing the ON/OFF operation at the critical angle, thereby improving the operability of the switch. Furthermore, by adjusting or changing the elevation difference $\alpha$ of the terminals or the height h of the guide member, as well as the gap $\beta$, the operation angle (tilt angle $\theta$) of the switch can be adjusted or changed. In addition, the present invention is provided with the simple structures, fewer components, the easy assembly operation, and thus is well equipped with productive potentialities.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A tilt switch comprising:

an insulating housing, one end of which is provided with an opening, the other end of which is a closed bottom, and which is in a case-shape;

a cover which covers the opening of said insulating housing;

three terminals which are parallel transfixed into terminal holes at the bottom of said housing, with one end of each of which being protruded into the housing, whereas the other end of each of which being protruded out of the bottom; and an electrically conductive ball member which is freely movable and accommodated in an interior of said housing, and serves as a movable contact;

wherein said terminals are respectively located at each vertex position forming an equilateral or isosceles triangular shape at the bottom of said housing, with one terminal having a polarity opposite to those of the other two terminals, and protruding inward to the housing by a length longer than those of the other two terminals, allowing slight elevation difference to exist between said one terminal and the other two terminals, wherein the switch is horizontally mounted to keep said electrically conductive ball member from contacting the terminals, for holding an OFF state, and wherein the triangle formed by the three terminals is an inverted triangle or an isosceles triangle configured such that one terminal of said three terminals is located at the vertex of said inverted triangle, the other two terminals are at two end vertices of the base of said inverted triangle, and said one terminal is disposed proximate to a position of an inner wall at a lower side of said insulating housing, and wherein when said housing tilts to enable the electrically conductive ball member to contact the three terminals, the electrically conductive ball member can be held at a stable and balanced contact state by said three terminals.

2. The tilt switch according to claim 1, wherein at least said one terminal at the vertex of said inverted triangle is configured as having freely adjustable protrusion length out of the insulating housing, relative to said insulating housing.

3. The tilt switch according to claim 1, wherein a central part of an inner wall of the insulating housing, facing said one terminal, is provided with a guide member which faces to and is parallel to the terminal, so as to change thickness of the guide member for adjusting the ON/OFF tilt angle of the switch.

4. The tilt switch according to claim 3, wherein the guide member in the insulating housing is formed integrally with the housing.

5. The tilt switch according to claim 3, wherein the guide member in the insulating housing is configured as being freely assembled with and disassembled from the housing.

* * * * *